US005184811A

United States Patent [19]

Sardella et al.

[11] Patent Number: 5,184,811

[45] Date of Patent: Feb. 9, 1993

[54] METHOD AND APPARATUS FOR FEEDING SHEETS

[75] Inventors: Louis M. Sardella, Cockeysville, Md.; John B. West, Virginia Beach, Va.

[73] Assignee: Sun Automation, Inc., Baltimore, Md.

[21] Appl. No.: 257,063

[22] Filed: Oct. 13, 1988

[51] Int. Cl.[5] ..... B65H 3/08

[52] U.S. Cl. ..... 271/10; 271/114; 271/118

[58] Field of Search ..... 271/10, 114, 118

[56] References Cited

U.S. PATENT DOCUMENTS

| | | | |
|---|---|---|---|
| 549,111 | 11/1895 | Crowell | 271/118 |
| 963,946 | 7/1910 | Saunders | 271/115 X |
| 976,640 | 11/1910 | Cowles | 271/118 |
| 1,092,437 | 4/1914 | Ferguson | 271/118 X |
| 1,441,271 | 1/1923 | Escobales | 271/118 |
| 3,193,282 | 7/1965 | Stewart | 271/12 |
| 3,486,749 | 12/1969 | Billings | 271/114 X |
| 4,494,745 | 1/1985 | Ward | 271/35 X |
| 4,614,335 | 9/1986 | Sardella | 271/118 X |
| 4,632,378 | 12/1986 | Sardella | 271/202 |

OTHER PUBLICATIONS

The Rotary Feed, pp. 53 through 57 by Lou Sardella (Publication).

*Primary Examiner*—Richard A. Schacher
*Attorney, Agent, or Firm*—William E. Mouzavires

[57] ABSTRACT

Paperboard sheets are fed by a feeder including driven wheels which engage the lowermost sheet of a stack and drive it through the nip rolls of a box-finishing machine is synchronism with the latter. Supporting the sheets is a grate movable between a raised position wherein the wheels are spaced from the sheet and a lowered position wherein the lowermost sheet engages the wheels and is fed thereby to the nip rolls. Below the grate is a vacuum box for holding the sheet on the wheels. Raising and lowering of the grate is effected by a cam which may be adjusted to vary the feed stroke in accordance with the length of the sheets. For driving the wheels there is provided a dual input drive mechanism including a constant velocity input drive and a variable input drive which are resolved at a single output drive to the wheels. The output drive varies in velocity such that when the wheels initially engage the sheet, the wheels are at nearly zero or absolute zero velocity and subsequently the wheels reach a constant velocity for driving the sheet at said constant velocity which is matched with the surface velocity of the nip rolls. In an alternative embodiment, the feeder may be adjusted to feed either a single sheet or a plurality of sheets per cycle of the associated box-finishing machine.

38 Claims, 6 Drawing Sheets

METHOD AND APPARATUS FOR FEEDING SHEETS

BACKGROUND OF INVENTION

Paperboard feeders are well-known in the prior art and they include various types of feeder elements which drive the lowermost sheet of a stack past a gate to the nip rolls of a box-finishing machine. One type of feeder is a "kicker bar" which engages the trailing edge of the sheet and pushes it to the nip rolls. More recent feeders include segmented wheels which are shown in U.S. Pat. No. 4,045,015 and engage the underside of the sheet; whole wheels shown in U.S. Pat. No. 4,614,335 and U.S. patent application Ser. No. 06/674,294, filed Nov. 23, 1984, entitled "Rotary-Type Feeder Machines and Methods" and which also engage the underside of the sheet; and belts shown in U.S. Pat. No. 4,494,745. In these more recent feeders, a vacuum or suction is utilized to hold the sheet on the feed elements and some feeders also use a grate movable above and below the feed elements to establish or terminate driving engagement between the sheet and feed elements.

With all of these types of feeders of the prior art, once the sheet enters the nip rolls, the feed element is disengaged from the sheet leaving the nip rolls to continue the feeding of the sheet to the next station in the box-finishing machine. It is most important that the sheet be fed to the nip rolls in "register" and with "matched velocity", meaning that the velocity of the sheet must equal the surface velocity of tee nip rolls, and further that the nip rolls feed the sheet in synchronism with the moving parts of the box-finishing machine.

One of the problems attendant feeders of the prior art is that the weight of the sheet stack and the added pressure on the sheet produced by the vacuum, produces a drag on the sheet being fed resulting in loss of registry or control of the sheet. To compensate for the drag on the sheet, it is necessary to increase pressure on the sheet from the nip rolls by adjusting the spacing between the nip rolls. However this can result in crushing the paperboard sheet which, in turn, will weaken the sheet. It can also deform the surface of the nip rolls which may produce a velocity change, making it impossible to match the velocity of the sheet with that of the nip rolls, and the velocity of the nip rolls with that of the other parts of the box-finishing machine. Moreover, when feeding corrugated board having creases perpendicular to the direction of flow, control of the sheet may be lost when the crease enters the nip rolls due to the surface depression of the crease. In addition, increasing the pressure of the nip rolls accelerates the wear on the nip rolls as well as their bearings and gears, thus shortening the life of these parts and requiring repair and production downtime.

OBJECTS OF THE INVENTION

An object of the present invention is to provide novel and improved methods and apparatus for feeding paperboard blanks or similar sheets. Included herein are such methods and apparatus that may be utilized to feed paperboard blanks to a box-finishing machine in highly accurate register or synchronism with the machine and which substantially reduces, if not eliminates, the problems described above heretofore attendant conventional feeders now in use.

A further object of the present invention is to provide a novel and improved feeder capable of feeding paperboard blanks or sheets through nip rolls of a box-finishing machine in registry with the velocity of the nip rolls. Included herein is such a feeder which will positively drive a substantial length of the sheet through and in registry with the nip rolls. Another object is to provide such a feeder which may utilize feed wheels or belts which engage the underside of the blanks or sheets to drive them to and through the nip rolls.

A further object of the present invention is to provide a sheet feeder which may be adjusted as desired in accordance with the length of the blank or sheet to change the feed stroke, i.e., the distance through which the sheet is positively fed or driven to and through the nip rolls of an associated machine.

A further object of the present invention is to provide a sheet feeder having an improved drive transmission for controlling the velocity of the feeder elements. Included herein is the provision of a drive transmission that drives the feeder elements such that when the feeder elements initially engage the sheet, they will be at nearly zero or absolute zero velocity and subsequently they will be at a constant predetermined velocity for driving the sheet at said constant velocity.

Another object of the present invention is to provide in a sheet feeder, a drive transmission combining a constant velocity input and a variable velocity input to drive feeder elements from a single output. Included herein is such a drive transmission whose output varies in velocity from absolute zero or nearly zero velocity for initially engaging a sheet to constant velocity for driving the sheet at said constant velocity.

Another object of the present invention is to provide a novel sheet feeder for box-finishing machines which feeder is capable of feeding a greater number of sheets per cycle of the box-finishing machine to increase the production of the machine but without increasing the inertia load on the machine. Included herein is such a sheet feeder that may be adjusted to feed either a single sheet or a plurality of sheets per cycle of the associated box-finishing machine. Further included herein is such a feeder that will achieve the foregoing objects in a lead-edge feeder, that is, a feeder that initially engages the leading edge of the sheet to be fed.

SUMMARY OF INVENTION

The present invention is preferably applied in a feeder for successively driving paperboard sheets through nip rolls of a box-finishing machine in synchronism with the latter. In the preferred form of the invention, the sheets are successively fed from a lowermost position in a stack of sheets which stack is lowered on feeder elements for driving the lowermost sheet to the nip rolls. After the sheet has been fed, the sheet stack is raised to disengage the fed sheet from the feeder elements and then the stack is lowered again to engage the next sheet to be fed on the feeder elements.

In accordance with the present invention, the sheets are positively driven to and through the nip rolls at a velocity which is matched to the surface velocity of the nip rolls. In the preferred embodiment, when the sheet initially engages the feeder elements, the latter are at nearly zero velocity. Subsequently, the feeder elements are driven at a constant velocity equal to the surface velocity of the nip rolls so that the sheet is driven to and through the nip rolls at the same matched velocity. A novel drive transmission is provided allowing the sheet to be positively driven through the nip rolls along a substantial portion of the length of the sheet, and at the conclusion of the feeding portion of the drive cycle, the velocity of the feeder elements is decreased to nearly zero velocity for engaging the next sheet to be fed while at this reduced velocity. The feeding portion of the cycle is then resumed to feed the next sheet at matched, constant velocity to and through the nip rolls.

In its preferred form, the drive transmission includes a constant velocity input drive and a variable velocity input drive which are resolved at a single output for driving the feeder elements through the aforementioned cycle. The period of engagement of the feeder elements with the sheets may be adjusted to change the length of the feeding stroke to suit the particular length of the sheets being fed.

DRAWINGS

Other objects and advantages of the present invention will become apparent from the following detailed description of the drawings in which.

DETAILED DESCRIPTION

Figure 1:
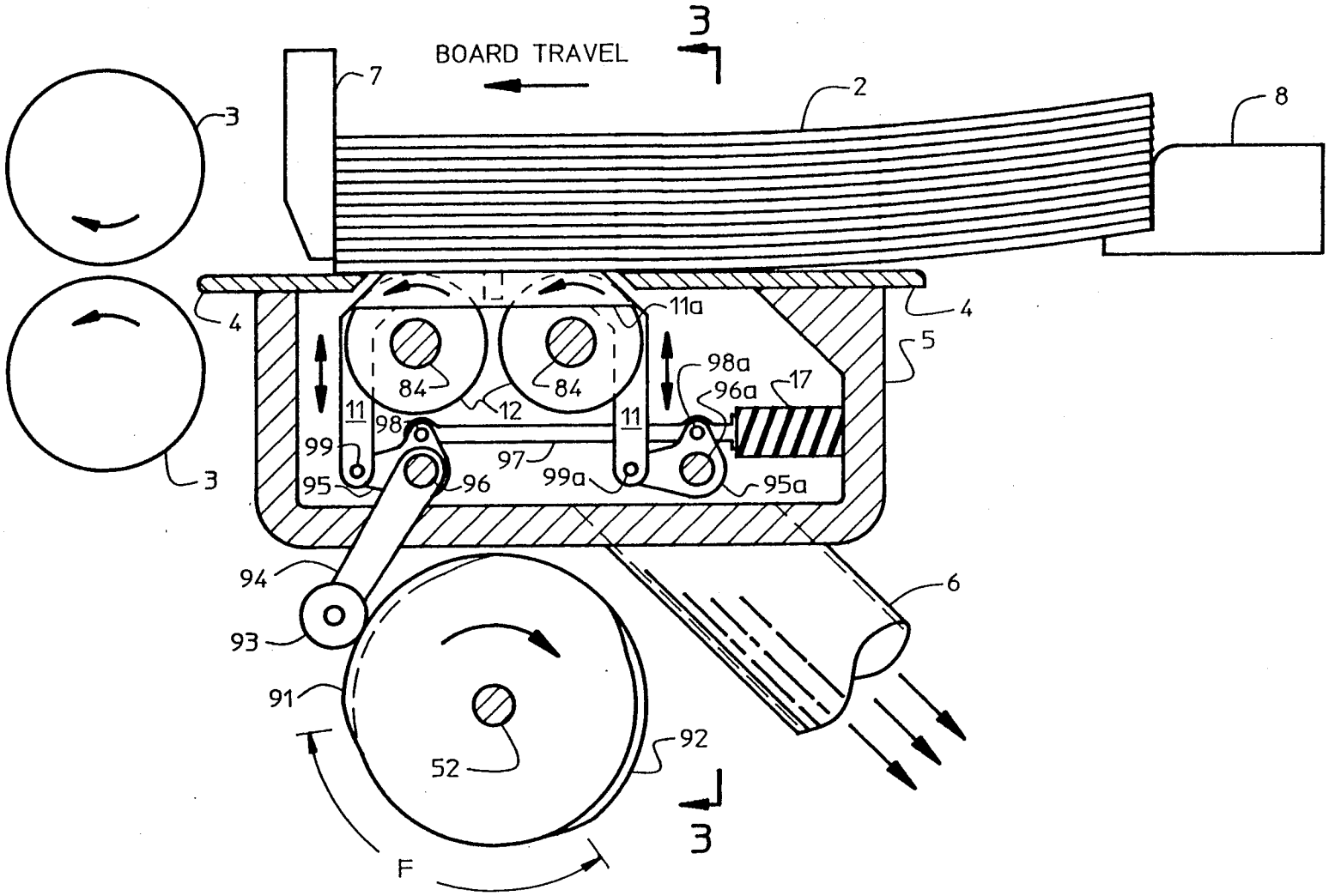
FIG. 1 is a cross-sectional view taken along the path of sheet travel of feeding apparatus incorporating a preferred embodiment of the present invention.

Referring now to the drawings in detail, there is shown in FIG. 1, for purposes of illustration only, a preferred embodiment of a sheet feeder incorporating the present invention for successively feeding paperboard or sheets 2 to and through nip rolls 3 of a box-finishing machine (not shown) located downstream of the nip rolls 3 where various operations are performed on the sheets in predetermined timed sequence. Sheets 2 are supplied in a stack located on a horizontal support plate 4 forming the top of an enclosure 5 defining a chamber in which a vacuum is produced through a manifold 6 communicating with the bottom of the chamber. The front or leading edges of the sheets 2 are located by a vertical gate 7 while the rear or trailing edges of the sheets are supported in a slightly raised position by a back stop 8. The enclosure 5 is supported on vertical walls 9 of a fixed support frame having a base 10 to which vertical walls 9 are suitable fixed.

Supported for vertical, up and down, movement within enclosure 5, is a grate 11 including in the top thereof a plurality of spaced runners 11*a* which underlie and support the sheet stack at the top 4 of the enclosure 5 which top 4 is open to receive the grate 11. Within enclosure 5 between certain of the grate runners 11*a* are respectively located a plurality of feeder elements which, in the preferred embodiment shown, are wheels 12 for positively driving the sheets 2 to nip rolls 3 as will be described in greater detail below. Feeder wheels 12 have a suitable high friction surface for engaging the underside of the lowermost sheet 2 in the sheet stack for positively driving the sheet upon rotation of the feeder wheels in the direction of the arrows shown in FIG. 1. For this purpose, wheels 12 are mounted on and for rotation with shafts 78 suitably journalled in vertical support walls 9 and 13 for rotation by a drive transmission to be described below. When grate 11 is in its uppermost raised position, the lowermost sheet 2 is spaced from the feed wheels 12 and no drive of course is imparted to the sheet. When the grate 11 is midway between its uppermost and lowermost position, the lowermost sheet 2 engages the feed wheels 12 and is positively driven under the gate 7 and to and then through the nip rolls 3 as will be further described below.

In the shown embodiment, vertical movement of grate 11 between its upper and lower positions is achieved through rocker arms 95 and 95*a* located at the opposite sides of the grate; there being a pair of such rocker arms at each side as best shown in FIG. 1. Each rocker arm 95 and 95*a* has dual arm portions spaced from each other approximately ninety degrees (90°). Rocker arm 95 has one arm portion pivotally connected by pivot pin 99 to a vertical leg projecting from the underside of grate 11 while the other arm portion is pivotally connected by pivot pin 98 to a connecting link 97 which is pivotally connected by pivot pin 98*a* to one of the arm portions of the other rocker arm 95*a*. The other arm portion of rocker arm 95*a* is pivotally connected by pivot pin 99*a* to a lug projecting from the underside of grate 11. Rocker arms 95 and 95*a* are mounted for rocking movement about rocker shafts 96 and 96*a* respectively to which they are suitably fixed. Rocker shafts 96 and 96*a* are suitably journalled fcr rotation in vertical support walls 9. When rocker arm 95 is pivoted in one direction by rotation of rocker shaft 96 as will be described below, it will raise the grate 11 through the connection at pivot pin 99 to the grate and the same raising action will take place simultaneously through the connection of the other rocker arm 95*a* to the grate at pivot pin 99*a* by virtue of the motion transferred from rocker arm 95 to rocker arm 95*a* by the connecting link 97. When the rocker arm 95 is pivoted in the opposite direction, the rocker arms 95 and 95*a* will lower the grate; and in the preferred embodiment, such action is assisted by a spring 17 interposed between one end of the connecting link 17 and the adjacent wall of enclosure 5.

Figure 2:
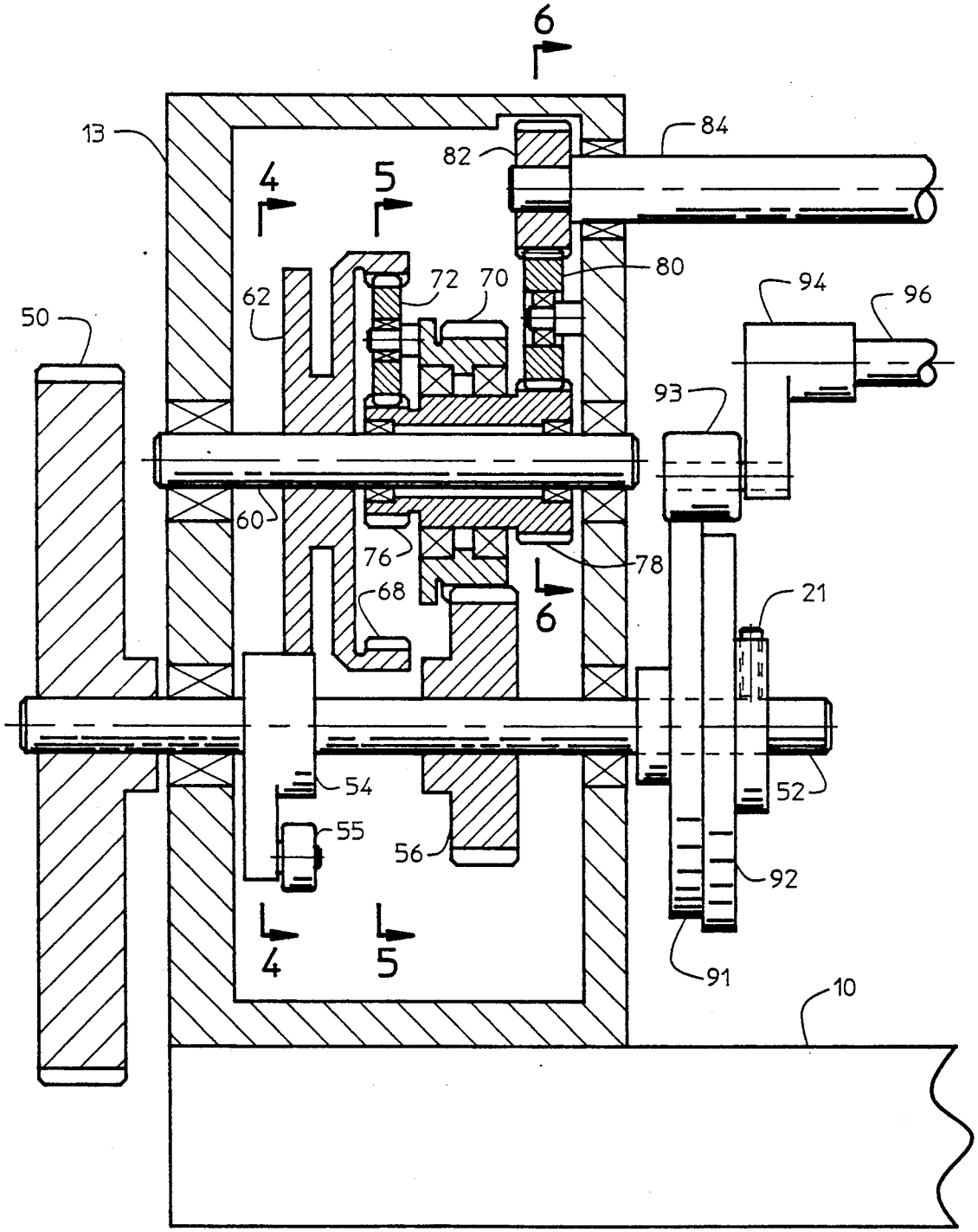
FIG. 2 is a transverse cross-sectional view taken generally through the drive transmission of the apparatus and with certain parts removed for clarity.
Figure 3:
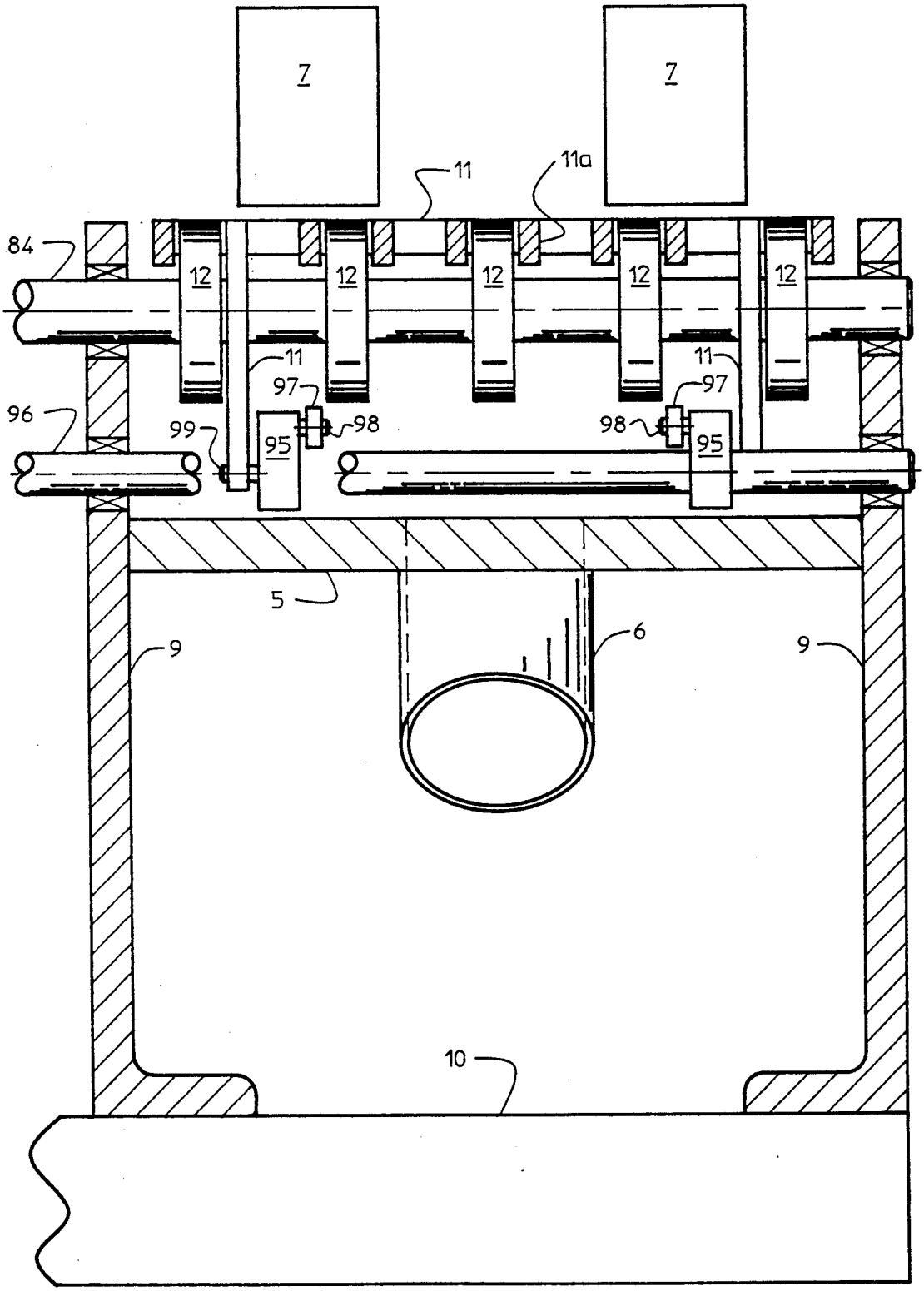
FIG. 3 is a cross-sectional view taken generally along lines 3—3 of FIG. 1 and with parts removed.

Actuation of rocker shaft 96 to drive the rocker arms 95 is achieved by a cam and cam follower assembly. In the preferred embodiment, a "split cam" is utilized including a first cam 91 for lowering the grate and a second cam 92 for raising the grate. As shown in FIGS. 1 and 2, cams 91 and 92 are fixed about a drive shaft 52 in abutting coaxial arrangement and with the cams being secured relative to each other in a predetermined angular interrelationship to move as a unit with drive shaft 52. Engageable with the cams 91 and 92 to be controlled thereby is a cam follower 93 mounted to the end of a cam follower arm 94 whose opposite end is mounted about and fixed to rocker shaft 96. When cam 92 engages cam follower 93, arm 94 will pivot clockwise (as viewed in FIG. 1) to rotate rocker shaft 96 in one direction and, in turn, rocker arms 95 to raise grate 11. When cam follower 93 leaves cam 92, arm 94 will pivot downwardly in the opposite direction guided by engagement with cam 91 thus reversing rotation of rocker arms 95 to lower grate 11.

As described above, while the grate 11 is in lowered position, the wheels 12 project above the grate runners 11*a* to engage and drive the sheet over a feeding stroke which is determined by the peripheral length F of the split cams 91, 92 which length is chosen in accordance with the length of the sheets 2 to be fed. The feed stroke is chosen such that the sheet is positively driven not only to the nip rolls 3 but also through the nip rolls 3 until the trailing edge of the sheet being fed leaves or uncovers the feed wheels 12 at which time cam 92 will engage cam follower 93 to raise grate 11. At this point in the cycle, the sheet is still passing through the nip rolls 3. By maintaining the positive drive on the sheet while it is passing through nip rolls 3 prior to raising grate 11, it is possible to maintain the sheet at matched velocity with respect to the nip rolls 3 for a substantial length of the sheet being fed.

In order to accommodate sheets 2 of different lengths, the cam 92 is angularly adjustable relative to cam 91 about shaft 52. This will, of course, vary the peripheral lengths of the cams 91 and 92 exposed to the cam follower 93 which will govern the length of the feed stroke during each cycle of revolution of the cams 91 and 92. Adjustability of the cams 91 and 92 may be effected in any suitable manner such as loosening the set screw 21 which fixes cam 92 to the drive shaft 52, and rotating cam 92 relative to shaft 52 and tightening screw 21.

Figure 4:
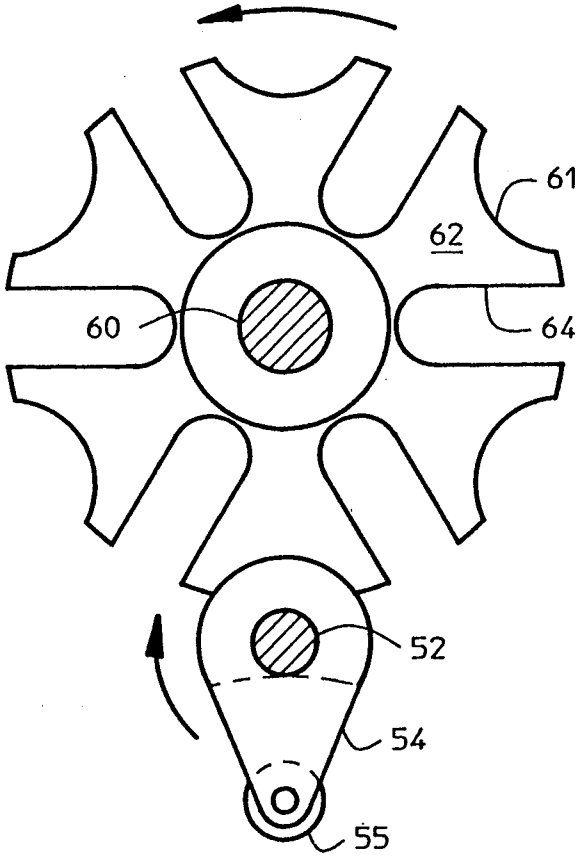
FIG. 4 is a cross-sectional view taken generally along lines 4—4 of FIG. 2 and with parts removed.

As shown in FIG. 2, the drive transmission for driving the feed wheels 12 includes an input drive gear 50 fixed to drive shaft 52 to be rotated by any drive element of the box making machine (not shown) one revolution for each complete cycle of the feeder. One cycle of the feeder equals one revolution of a major "repeat" cylinder of the box making machine, such as a print cylinder or die cutting cylinder. Drive shaft 52 drives a first, variable velocity input and a second, constant velocity input. Referring to FIGS. 2 and 4, in the preferred embodiment the variable velocity input includes an indexing drive comprised of a geneva star wheel 62 mounted on a shaft 60. Star wheel 62 has radial slots 64 for receiving a follower 55 of an indexing driver arm 54 which is fixed about drive shaft 52 to be driven thereby periodically. When follower 55 is in one of the slots 64, the star wheel is driven with varying velocity and when follower 55 is disengaged from the slots 64, the star wheel is of course stationary by receipt of the indexing driver arm 54 in one of the arcuate recesses 61 in the star wheel. Another indexing mechanism is shown in U.S. Pat. No. 4,045,015 to Sardella.

The constant velocity input includes in the preferred embodiment, a constant velocity driver gear 56 fixed about drive shaft 52 to be driven thereby. The variable velocity input provided by the star wheel 62 and the constant velocity input provided by the driver gear 56 are combined and transferred to a simple output by means of a planetary or epicyclic gear system in the preferred embodiment. The latter includes a ring gear 68 shown as fixed to the star wheel 64 to be driven thereby, and a plurality of planet gears 72 in mesh with the ring gear 68 and a sun gear 76 rotatably mounted about shaft 60. Planet gears 72 are mounted in a carrier gear 70 to drive the same; the carrier 70 being mounted about a hub portion of the sun gear 76. The carrier gear 70 has a gear formed on its outer circumferential surface in mesh with the constant velocity driver gear 56 to be driven by the latter. The variable and constant velocity inputs are thus resolved at the sun gear 76 and directly transferred to an output driver gear 78 which, in the shown embodiment, is integral with the sun gear 76 and rotatably mounted about shaft 60.

Figure 6:
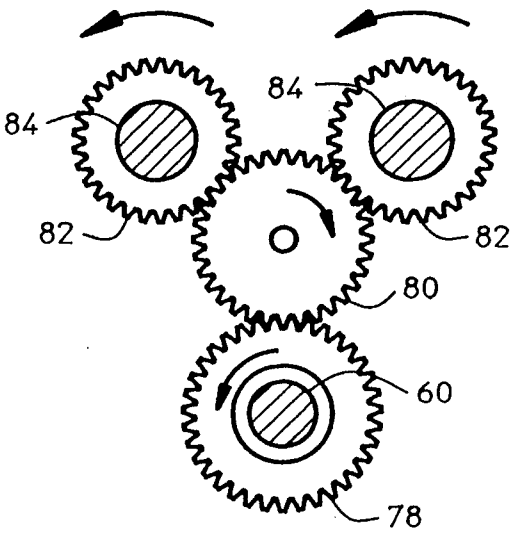
FIG. 6 is a cross-sectional view taken generally along lines 6—6 of FIG. 2.
Figure 5:
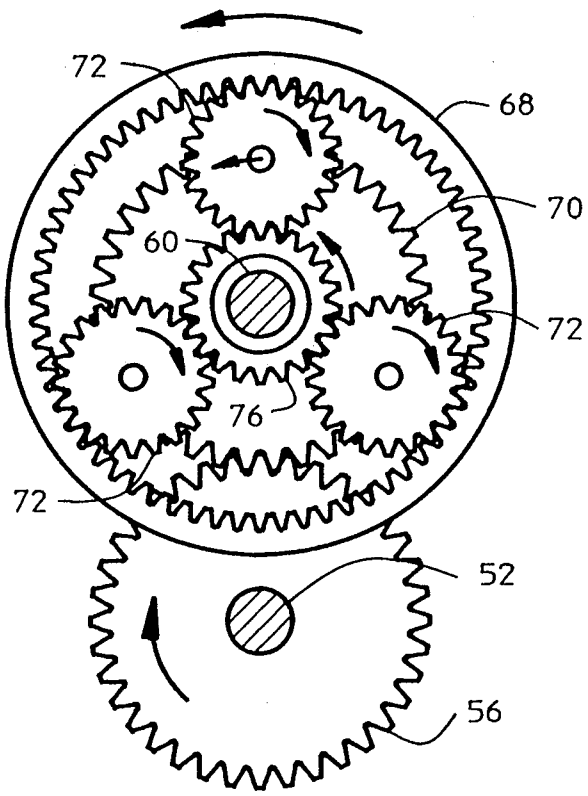
FIG. 5 is a cross-sectional view taken generally along lines 5—5 of FIG. 2 and with parts removed.

In the preferred embodiment and referring to FIGS. 2 and 6, the output of the driver gear 78 is transferred to the wheel shafts 84 to drive the feed wheels 12 by means of an idler gear 80 in mesh between the output driver gear 78 and a plurality of wheel shaft gears 82 fixed respectively to the wheel shafts 84 to drive the same.

Figure 7:
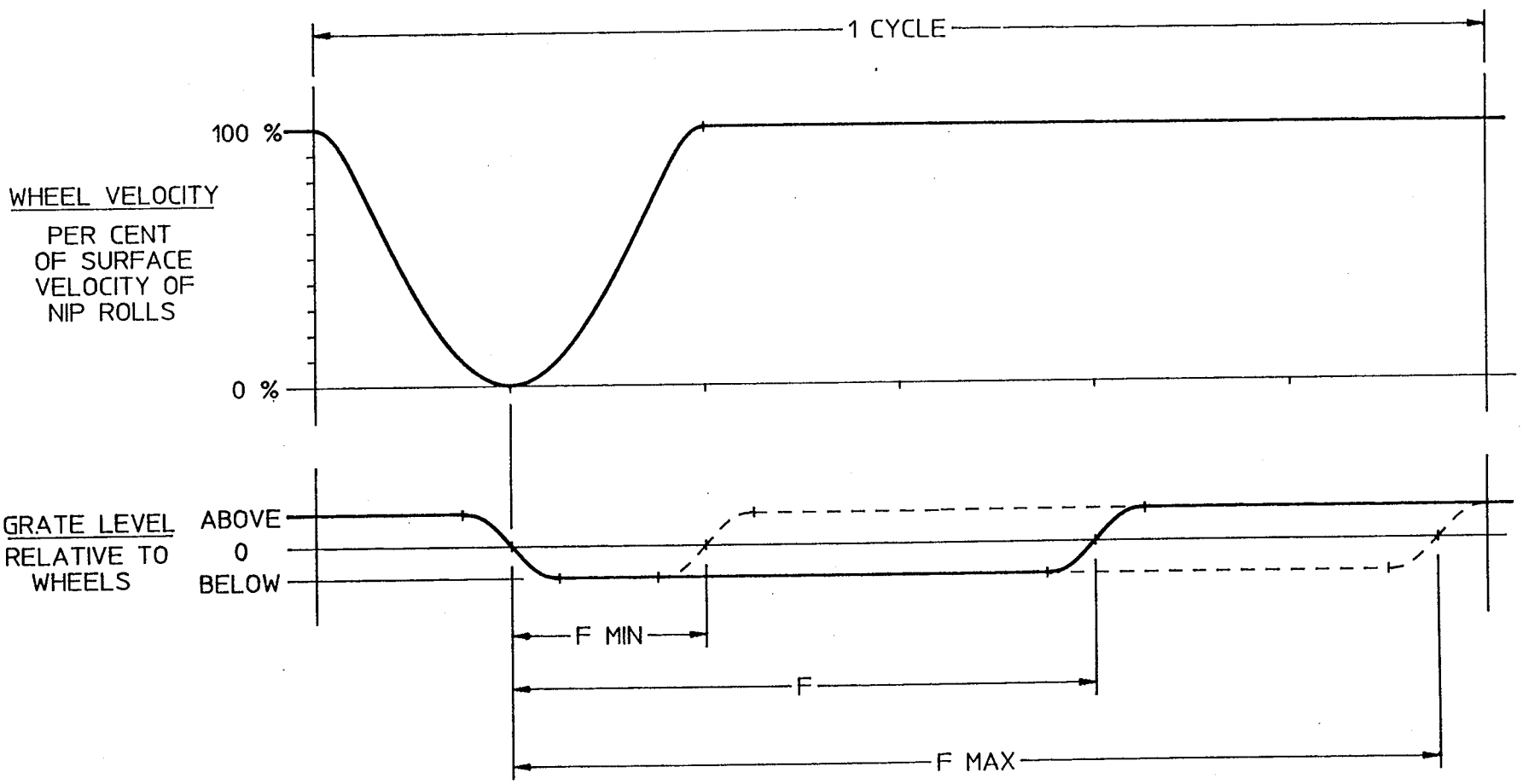
FIG. 7 is a view of two graphs, one showing the velocity of feed wheels included in the apparatus and the other showing the position of a grate included in the apparatus.

The velocity of the feed wheels 12 during one complete, cycle of operation of the feeder is illustrated in FIG. 7 wherein the maximum velocity of the feed wheels 12 is equal to the surface velocity of the nip rolls 3. As shown in the upper graph of FIG. 7, in the beginning portion of the cycle the velocity of the feed wheels 12 decreases from the maximum velocity and this is achieved by the substracting effect of the velocity of the star wheel 62 on the constant velocity effect of the driver gear 56. The velocity of the feed wheels is thus reduced to nearly zero whereupon the substracting effect of the star wheel velocity becomes less and less and the velocity of the feed wheels 12 thus begins to increase until it reaches maximum velocity and the star wheel follower 55 leaves the star wheel slot 64. At this point, the star wheel is stopped and the maximum velocity is maintained constant until the end of the cycle by virtue of the effect of the constant velocity driver gear 56 which continues to drive the output driver gear 78 at constant velocity. When the star wheel follower 55 reenters the next slot 64 of the star wheel, the next cycle will begin to repeat the above process.

The lower graph of FIG. 7 illustrates the position of the grate 11 during one cycle in relation to the velocity of the feed wheels 12 illustrated by the upper graph. At the beginning of the cycle, the grate is raised as the wheel velocity is decreasing, and when the wheel velocity begins to approach nearly zero velocity, the grate begins to descend as controlled by the cam 91 as described above. When the wheel velocity reaches nearly zero, the grate 11 has descended approximately half way to the lowermost position and the lowermost sheet 2 initially engages the feed wheels 12. As the wheel velocity begins to increase, the grate 11 reaches its lowermost position and the sheet is fed with a gradually increasing velocity until maximum velocity is reached whereupon the sheet is fed with constant maximum velocity equal to the surface velocity of the nip rolls 3 prior to entry of the sheet into nip rolls. Before the trailing edge of the sheet 2 being fed uncovers the feed wheels 12, the grate lifting cam 92 engages the grate drive cam follower 93 to begin to lift the grate, and when the grate elevates the sheet from the feed wheels 12, positive feeding of the sheet by the feed wheels 12 stops but the sheet continues to be conveyed by the nip rolls 3 to the box-finishing machine. Note that during this phase of the cycle, the feed wheels 12 in the embodiment shown continue to be driven at maximum velocity until the end of the cycle. The length of the feed stroke in the particular embodiment shown is designated F in FIG. 7. By angularly adjusting the cams 91 and 92 relative to each other as described above, the length or duration of the feed stroke may be adjusted between a maximum, F max and a minimum, F min. to suit the length of the sheets 2 to be fed.

Although, in the specific embodiment shown, the sheets 2 initially engage the feed wheels 12 when the latter are at nearly zero velocity, the transmission of the present invention may be designed such that the wheels 12 at initial engagement with the sheet, will be at absolute zero velocity for a momentary period or at absolute zero velocity for a dwell period.

It should be understood that although feed wheels 12 have been utilized in the embodiment shown and described above, endless drive members (not shown) such as belts may be employed instead.

It will therefore be seen that the present invention allows the sheets to be fed with a predetermined, matched velocity without damaging or losing control of the sheets or causing undue wear of the nip rolls and its associated parts.

Figure 10:
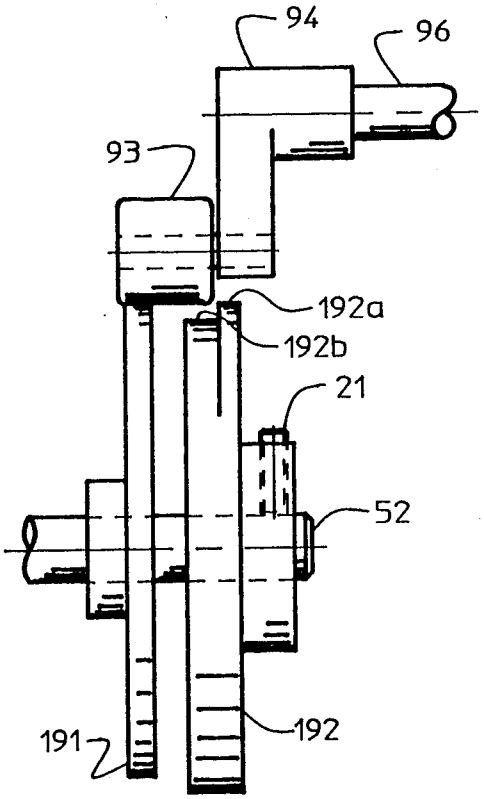
FIG. 10 is a view generally similar to a portion of FIG. 2 but illustrating the cam of FIG. 9.
Figure 9:
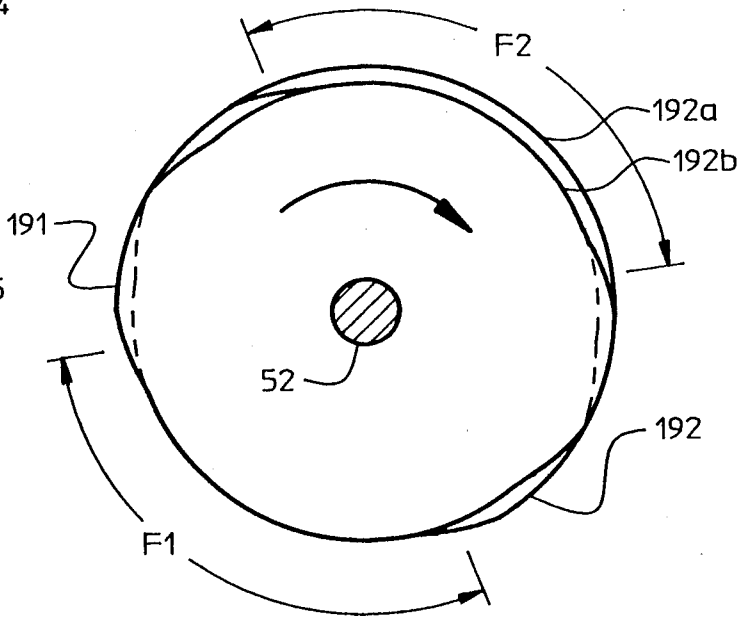
FIG. 9 is a view generally similar to a view of a split cam shown in FIG. 1 but illustrating another cam that may be employed instead to obtain the feeding of two sheets per cycle.
Figure 8:
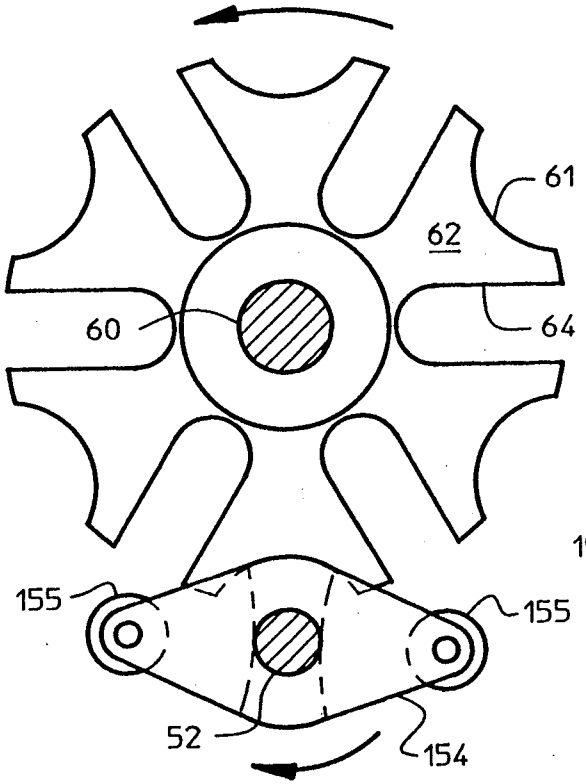
FIG. 8 is a view generally similar to FIG. 4 but illustrating another geneva drive that may be utilized instead to obtain the feeding of two sheets per cycle.

In situations where the sheets or paperboards have a length less than one half of the "repeat length" of the box-finishing machine, the feeder of the present invention may be used to feed two sheets per cycle of the machine. The "repeat length" is the circumferential length of the main cylinder of the box-finishing machine which cylinder may be a printing cylinder, a die cutting cylinder or a slotting head cylinder. One revolution of such a cylinder constitutes one cycle of the box-finishing machine. Referring to FIGS. 8, 9 and 10, a modification of a portion of the feeder is shown utilizing an indexing driver arm 154 having a pair of followers 155 for driving the geneva star wheel 62 at two spaced intervals during each cycle or revolution of the drive shaft 52 which cycle is the same as that of the main cylinder of the box-finishing machine. Referring to FIG. 9, in the present modification, another type of split cam is used including a cam 191 and a cam 192. When the sectors Fl and F2 of the split cam engage the cam follower 93, the grate 11 will be positioned below the feed wheels 12 exposing the feed wheels for feeding sheets thus allowing two sheets to be fed to the pinch rolls of the box-finishing machine during each cycle of the machine in cases where the length of the sheets is less than one half of the repeat length of the machine. When the sectors of the split cam lying between Fl and F2 engage the cam follower 93 (see FIG. 10), the grate will be raised above the feed wheels 12 such that no feeding of the sheets by the feed wheels 12 will occur. In order to allow the split cam to be used for feeding one sheet per cycle or two sheets per cycle, cam 192 is provided with alternate lands **192*a* and 192*b* on a section of its periphery as shown in FIGS. 9 and 10. By adjusting the split cam axially along drive shaft 52, either cam surface 192*a* or 192*b* can be brought into operation depending on whether one or two sheets are to be fed per cycle of the machine. FIG. 10 shows the split cam adjusted to bring cam surface 192*b* into position for feeding two sheets per cycle. During such a double sheet feed mode, the grate position and wheel velocity graphs shown in FIG. 7 will be duplicated during the second half of each cycle. In order to adjust the split cam for feeding one sheet per cycle, the set screw in the specific embodiment, is loosened and the split cam is moved axially along the drive shaft to bring cam surface 192*a* of cam 192** into play.

It will thus be seen that the modification of FIGS. 8, 9 and 10 will allow, in certain cases where the sheet length is less than one half of the repeat length of the machine, to substantially increase the production of the machine by feeding two sheets instead of one sheet per cycle. Moreover, because of the drive system for driving the sheet feeder elements of the present invention, the inertia load on the system will not be increased when feeding two sheets per cycle thereby avoiding breakdown of the feeder mechanism due to excessive loading such as may occur when other prior art systems are employed, one for example being shown in U.S. Pat. No. 3,422,757, Grobman et al. The latter discloses a double sheet feeder utilizing a rocker and slide drive. In addition, and in contrast to the Grobman et al slide bar feeder which engages the trailing edge of the sheet, the feeder of the present invention advantageously is a leading edge feeder. Moreover, the feeder of the present invention allows adjustment to either a single sheet feed or a double sheet feed.

What is claimed is:

1. A method of feeding a sheet to nip rolls of a box-finishing machine wherein the nip rolls are rotating in opposite directions at a predetermined surface velocity, the steps comprising frictionally engaging a feed member with the sheet to positively drive the sheet to and between the nip rolls, driving the feed member with a surface velocity matching said surface velocity of the nip rolls to positively engage and drive a substantial length greater than one half the length of the sheet through the nip rolls and maintaining the surface velocity of the feed member constant and equal to said surface velocity of the nip rolls over a substantial length greater than one half the length of the sheet as the sheet is driven through the nip rolls and wherein the feed member is driven with a first variable velocity input drive and a second constant velocity input drive.

2. The method defined in claim 1 including the step of initially engaging the sheet with the feed member while the feed member is at nearly zero surface velocity.

3. The method defined in claim 1 including the steps of initially engaging the sheet with the feed member while the feed member is at nearly zero surface velocity and then increasing the surface velocity of the feed member until it reaches said surface velocity of the nip rolls.

4. The method defined in claim 3 including the step of reducing the surface velocity of the feed member after the sheet passes beyond said feed member to ready the feed member to engage another sheet to be successively fed to the nip rolls.

5. The method defined in claim 1 including the step of initially engaging the sheet with the feed member while the feed member is at absolute zero velocity.

6. In a box-finishing machine or the like including a rotatable major repeat cylinder having a repeat length and having nip rolls rotatable in opposite directions at a predetermined surface velocity for feeding sheets to the repeat cylinder; apparatus for positively feeding a sheet to and through the nip rolls comprising in combination a feed member engageable with a sheet to drive it to and between said nip rolls, and drive means for driving said feed member such that the sheet is positively fed through the nip rolls by said feed member at a velocity matched to said predetermined surface velocity of said nip rolls and wherein said drive means drives the sheet through the nip rolls at a constant velocity for a distance equal to at least a substantial portion greater than one half of the repeat length of said repeat cylinder and wherein said drive means includes a first variable velocity input drive and a second constant velocity input drive.

7. The apparatus defined in claim 6 wherein said feed member includes a wheel rotatable by said drive means.

8. The apparatus defined in claim 7 wherein said wheel has a friction surface engageable with the sheet to positively drive the sheet.

9. The apparatus defined in claim 6 wherein said drive means controls the velocity of said feed member between nearly zero velocity for initially engaging the sheet and said predetermined matched velocity for driving the sheet through said nip rolls.

10. The apparatus defined in claim 6 wherein said drive means controls the velocity of said feed member between absolute zero velocity for initially engaging the sheet and said predetermined matched velocity for driving the sheet through said nip rolls.

11. The apparatus defined in claim 6 wherein said drive means includes a planetary transmission, said first variable velocity input drive being operatively connected to said planetary transmission, and said second constant velocity input drive being operatively connected to said planetary transmission.

12. The apparatus defined in claim 11 wherein said variable velocity input drive is an indexing drive.

13. A sheet feeder comprising in combination, a feed member for engaging a sheet to drive it along a predetermined path, and drive mans for driving the feed member over a cycle wherein said feed member increases from nearly zero velocity to a predetermined velocity which is maintained constant for a predetermined stroke period, and wherein said sheet initially engages said feed member when the feed member is at nearly zero velocity and subsequently is driven at said constant velocity during said predetermined stroke period and wherein said drive means includes a first variable velocity input drive and a second constant velocity input drive.

14. The sheet feeder defined in claim 13 wherein said drive means includes a planetary gear transmission and said first and second input drives are operatively connected to said planetary gear transmission to drive the same.

15. The sheet feeder defined in claim 14 wherein said first input drive includes an indexing drive member.

16. A sheet feeder comprising in combination, a feed member for engaging a sheet to drive it along a predetermined path, and drive means for driving the feed member over a cycle wherein said feed member increases form absolute zero velocity to a predetermined velocity which is maintained constant for a predetermined stroke period, and wherein said sheet initially engages said feed member when the feed member is at absolute zero velocity and subsequently is driven at said constant velocity during said predetermined stroke period and wherein said drive means includes a first variable velocity input drive and a second constant velocity input drive.

17. The sheet feeder defined in claim 16 wherein said drive means includes a planetary gear transmission and said first and second input drives are operatively connected to said planetary gear transmission to drive the same.

18. The sheet feeder defined in claim 17 wherein said first input drive includes an indexing drive member.

19. A sheet feeder for feeding sheets to nip rolls of a box-finishing machine, the feeder comprising in combination a feed member for engaging a sheet to drive it along a predetermined path, and drive means for driving the feed member over a cycle with a variable velocity, said drive means including a planetary gear system, a first variable velocity input drive operatively connected to the planetary gear system, and a second constant velocity input drive operatively connected to the planetary gear system, said planetary gear system having an output for driving said feed member at a variable velocity and at a constant velocity during said cycle, and wherein said variable velocity input drive includes an indexing drive member.

20. The sheet feeder defined in claim 19 wherein said planetary gear system includes a ring gear operatively connected to the indexing drive member, a carrier gear having planetary gears in mesh with the ring gear, a sun gear in mesh with said carrier gear, and wherein said second constant velocity input drive is operatively connected to said sun gear.

21. A sheet feeder comprising in combination, a feed member for engaging a sheet to drive it along a generally horizontal path, a grate movable above and below the feed member to respectively release and engage the sheet relative to the feed member, drive means for driving the grate including a first cam for raising the grate and a second cam for lowering the grate, and means for adjusting the cams relative to each other to vary the point at which the grate is moved above the feed member to release the sheet from the feed member.

22. The sheet feeder defined in claim 21 wherein said drive means includes a follower engageable with said cams, and wherein one of said cams has two axially spaced cam surfaces, one of which is engaged with said follower.

23. A sheet feeder comprising in combination a plurality of feed members for engaging a sheet to drive it along a generally horizontal path, a grate movable between a raised position above the feed members for disengaging the sheet and the feed members and a lowered position for engaging the sheet on the feed members, drive means for driving the feed members at a constant velocity for a predetermined period for positively driving the sheet, said drive means including an output operatively connected to the feed members to drive the same, a first input drive of varying velocity operatively connected to the output and a second input drive of constant velocity operatively connected to the output.

24. The sheet feeder defined in claim 23 wherein said first input drive is a geneva indexing drive and said drive means further includes a planetary gear system including said output.

25. The sheet feeder defined in claim 24 further including a cam drive means for driving said grate between said positions in synchronism with said drive means for driving said feed members, said cam drive means including a first cam for raising the grate to said raised position and a second cam for lowering said grate to said lowered position, and means for adjusting the one of said cams relative to the other cam to change said predetermined period in which the feed members are positively driven at said constant velocity.

26. The sheet feeder defined in claim 25 wherein said feed members are wheels each having a continuous peripheral friction surface engageable with the sheet to positively drive the same.

27. The sheet feeder defined in claim 25 wherein said drive means includes a follower engageable with said cams, and wherein one of said cams has two axially spaced cam surfaces, one of which is engaged with said follower.

28. In a box-finishing machine including nip rolls, a sheet feeder for feeding sheets to the nip rolls, the sheet feeder comprising in combination a feed member for engaging a sheet to drive it along a predetermined path to the nip rolls, and drive means for driving the feed member over a cycle with acceleration and then a constant velocity, said drive means including a planetary gear system, a first variable velocity input drive operatively connected to the planetary gear system, and a second constant velocity input drive operatively connected to the planetary gear system, said planetary gear system having an output for driving said feed member with acceleration and then with a constant velocity during each cycle.

29. A sheet feeder comprising in combination a feed member for engaging a sheet to drive it along a predetermined path, drive means for driving the feed member over a cycle with a variable velocity, said drive means including a planetary gear system, a first variable velocity input drive operatively connected to the planetary gear system, and a second constant velocity input drive operatively connected to the planetary gear system, said planetary gear system having an output for driving said feed member at a variable velocity and at a constant velocity during said cycle, and wherein said variable velocity input drive includes an indexing drive member.

30. The feeder defined in claim 29 wherein said output of the planetary gear system drives the feed member at a constant velocity over half of said cycle.

31. A sheet feeder comprising in combination, a plurality of feed members for engaging a sheet to drive it along a predetermined path, and drive means for driving the feed members such that the velocity of the sheet increases from nearly zero velocity to a predetermined velocity which is maintained constant for a predetermined period, and wherein said drive means includes a first variable velocity input drive and a second constant velocity input drive.

32. The sheet feeder defined in claim 31 wherein said input drives are operatively connected to a common output which drives all of the feed members.

33. The sheet feeder defined in claim 31 further including means located between the feed members for raising or lowering a sheet relative to the feed members.

34. The sheet feeder defined in claim 31 wherein said feed members include a feed member driven at a constant velocity for at least a portion of a cycle and a feed member driven at a variable velocity.

35. A sheet feeder comprising in combination, a plurality of feed members for engaging a sheet to drive it along a predetermined path, and drive means for driving the feed members such that the velocity of the sheet increases from absolute zero velocity to a predetermined velocity which is maintained constant for a predetermined period, and wherein said drive means includes a first variable velocity input drive and a second constant velocity input drive.

36. The sheet feeder defined in claim 35 wherein said input drives are operatively connected to a common output which drives all of the feed members.

37. The sheet feeder defined in claim 35 further including means located between the feed members for raising or lowering a sheet relative to the feed members.

38. The sheet feeder defined in claim 35 wherein said feed members include a feed member driven at a constant velocity for at least a portion of a cycle and a feed member driven at a variable velocity.

* * * * *